US007868906B2

(12) United States Patent
Mindler et al.

(10) Patent No.: US 7,868,906 B2
(45) Date of Patent: Jan. 11, 2011

(54) THERMAL PRINTER WITH REDUCED DONOR ADHESION

(75) Inventors: Robert F. Mindler, Churchville, NY (US); Daniel P. Hannon, Ontario, NY (US)

(73) Assignee: Eastman Kodak Company, Rochester, NY (US)

( * ) Notice: Subject to any disclaimer, the term of this patent is extended or adjusted under 35 U.S.C. 154(b) by 851 days.

(21) Appl. No.: 11/747,821

(22) Filed: May 11, 2007

(65) Prior Publication Data

US 2008/0278561 A1 Nov. 13, 2008

(51) Int. Cl.
*B41J 2/335* (2006.01)

(52) U.S. Cl. ..... 347/171

(58) Field of Classification Search ..... 347/171–223
See application file for complete search history.

(56) References Cited

U.S. PATENT DOCUMENTS 5,196,863 A 3/1993 Palmer et al.
5,284,816 A * 2/1994 Stephenson ..... 503/227
5,300,952 A * 4/1994 Wada et al. ..... 347/217
5,441,353 A 8/1995 Kim
5,499,880 A 3/1996 Pickering et al.
5,798,783 A 8/1998 Maslanka et al.
5,838,357 A 11/1998 Maslanka et al.
5,841,460 A 11/1998 Maslanka et al.
5,850,246 A 12/1998 Maslanka et al.

* cited by examiner

*Primary Examiner*—Daniel Petkovsek
(74) *Attorney, Agent, or Firm*—Roland R. Schindler; Eugene I. Shkurko

(57) ABSTRACT

Thermal printers and methods for operating thermal printers are provided. In one method, a sequence of thermal print head control signals is generated that is adapted to cause an array of thermal elements to cause the donor material to transfer from a donor ribbon in a manner that is modulated in accordance with image data and attenuated in accordance with an attenuation pattern. A receiver medium is urged through the printing nip while the thermal print head control signals are transmitted to the thermal print head to cause the donor material to transfer from the donor web in an image modulated pattern having a longitudinal length that is larger than a longitudinal length of the receiver medium. The attenuation pattern provides a relatively high level of attenuation at a portion of the printing wherein there is greater risk that the receiver medium will not be within the printing nip.

8 Claims, 17 Drawing Sheets

THERMAL PRINTER WITH REDUCED DONOR ADHESION

FIELD OF THE INVENTION

This invention relates in general to methods of printing and printers and in particular to methods of borderless printing and printers for providing borderless prints.

BACKGROUND OF THE INVENTION

Many photographers use digital cameras to capture images. Unlike conventional wet processing of silver halide film and papers, digital images can be printed directly onto sheets of paper. Color images can be printed using ink jet printers, multicolor transferable toner printers, heat sensitive coated paper printers, or thermal dye transfer printers. Many mass-market retail establishments have user-friendly kiosks where shoppers can make color prints. A large number of these kiosks use thermal dye transfer printers. Because the kiosks use large amounts of paper, such kiosks often use a continuous web of paper for printing such images. The images are later separated from each other and from the web by a suitable cutter or knife. In such kiosk printers, the cutting process is typically performed in a manner that ensures that the printed images provided to the user have dye images extend to the edges of the print in both the latitudinal and longitudinal directions. These prints are known as borderless prints and are the most popular prints.

Thermal dye transfer printers generate very high quality images. As such, a number of photographers want their own thermal dye transfer printer. However, it is impractical and not cost effective to supply continuous web paper for use in home printing. It is also expensive to supply built-in paper cutters and knives to provide borderless prints. To attempt to meet the demand for borderless prints, there are known methods of extending the latitudinal edges so that there is no border on the tops and bottoms of prints. See, for example, U.S. Pat. Nos. 5,441,353; 5,196,863; and 5,499,880. However, those techniques cannot provide prints that extend to the longitudinal borders.

One approach to providing borderless prints in a sheet fed thermal printer is modeled after the technique used by home printers. In this approach receiver sheets are provided that are pre-perforated at a distance from each longitudinal edge. FIG. 1 shows a prior art thermal dye transfer printer 2 that is intended to provide monotone, multi-tone or full color borderless printing using a perforated sheet 4 is shown in FIG. 1. Printer 2 records images on a sheet 4 that is driven along a print path by a pair of pinch rollers 6*a* and 6*b* connected to a motor 7. A print head 8 is located opposite a free spinning platen 10 through which sheet 4 is passed during printing. Donor take-up roller 12 and donor supply roller 14 support a donor web 16 of thermal dye donor material and are positioned on opposite sides of print head 8 so that donor web 16 passes between print head 8 and platen 10. A bias spring 18 presses print head 8 against donor web 16 to urge donor web 16 against platen 10.

Prior to printing, a leading edge 4.1 of sheet 4 is fed between rollers 6*a* and 6*b*. Rollers 6*a* and 6*b* pull sheet 4 and donor web 16 between thermal print head 8 and platen 10 where thermal print head 8 causes donor material to be transferred to sheet 4.

Sheet 4 is perforated to provide a separable perforated leading portion 4.1 and a trailing portion 4.3 bordering a central portion 4.2. Donor material, such as a dye, is transferred to sheet 4 such that an image is formed that causes the entire central portion 4.2 and that optionally extends to leading portion 4.1 and trailing portion 4.3 slightly beyond the perforations. When leading portion 4.1 and trailing portion 4.3 are removed at the perforations, central portion 4.2 bears a printed image that extends from edge to edge, and the print appears to be borderless.

A key drawback of this solution is the requirement for special paper with perforations on the leading and trailing edges. Such paper is expensive to manufacture and has little or no other market outside of printing digital images. In addition, customers can be dissatisfied with the requirement of tearing off the perforated edges of the printed images.

Another approach to providing borderless sheet fed prints is to provide a thermal printer with systems that precisely detect the leading edge of a sheet 4 and that precisely positions a leading edge of a sheet at a print head. However, it will be understood that print lines in thermal printers can be arranged on the order of 300 or more lines per longitudinal inch of a sheet. It also will be understood that even a minor border on the order one print line will not be acceptable as a borderless print. This requires that the sensing and positioning equipment in the thermal printer be very precise, thus raising the cost of the printer.

Further, it will be understood that even minor variations in a length of sheet 4, in the sheet transport systems used to position sheet 4 for printing, or in the equipment used to sense the position of sheet 4 can allow for a portion of sheet 4 to be advanced past print head 8 such that a border will appear. Such variations can also cause the leading longitudinal edge to be positioned before the print head such that the printer will begin printing before the longitudinal edge is positioned to receive the print. When this occurs, the leading edge longitudinal edge will appear to be borderless, however, because the printer begins printing without the leading edge at the print head and because the printer will print a predefined length, this problem creates a risk that the printer will stop printing before the trailing edge of the sheet has reached the print head thus creating a border at a trailing edge.

What is needed therefore is a printer and a method for printing that can achieve borderless printing without requiring the use of tear off receiver medium and/or slitting without precision sensing and positioning, and without a border. Such a system should be inexpensive and highly reliable.

SUMMARY OF THE INVENTION

Thermal printers and methods for operating a thermal printer having a thermal print head with an array of thermal elements position opposite a platen at a printing nip and with a donor web having thermal donor material positioned between the print head and the platen. The thermal elements are adapted to heat the donor web in accordance with received control signals so that donor material can be transferred from the donor web to the receiver medium. In accordance with the method a leading edge of the receiver medium is moved proximate to the printing nip. A sequence of thermal print head control signals is generated that is adapted to cause the array of thermal elements that causes the donor material to transfer from the donor web in a manner that is modulated in accordance with the image data and attenuated in accordance with an attenuation pattern. The leading edge of the receiver medium is urged through the printing nip while the thermal printhead control signals are transmitted to the thermal print head to cause the donor material to transfer from the donor web in an image modulated pattern having a longitudinal length that is larger than a longitudinal length of the receiver medium. The attenuation pattern provides a relatively high level of attenuation at a portion of the printing wherein there is a greater risk that the receiver medium will not be within the printing nip than at a portion of the printing wherein there is a lesser risk that the receiver medium will not be within the printing nip.

DETAILED DESCRIPTION OF THE INVENTION

Figure 5A:
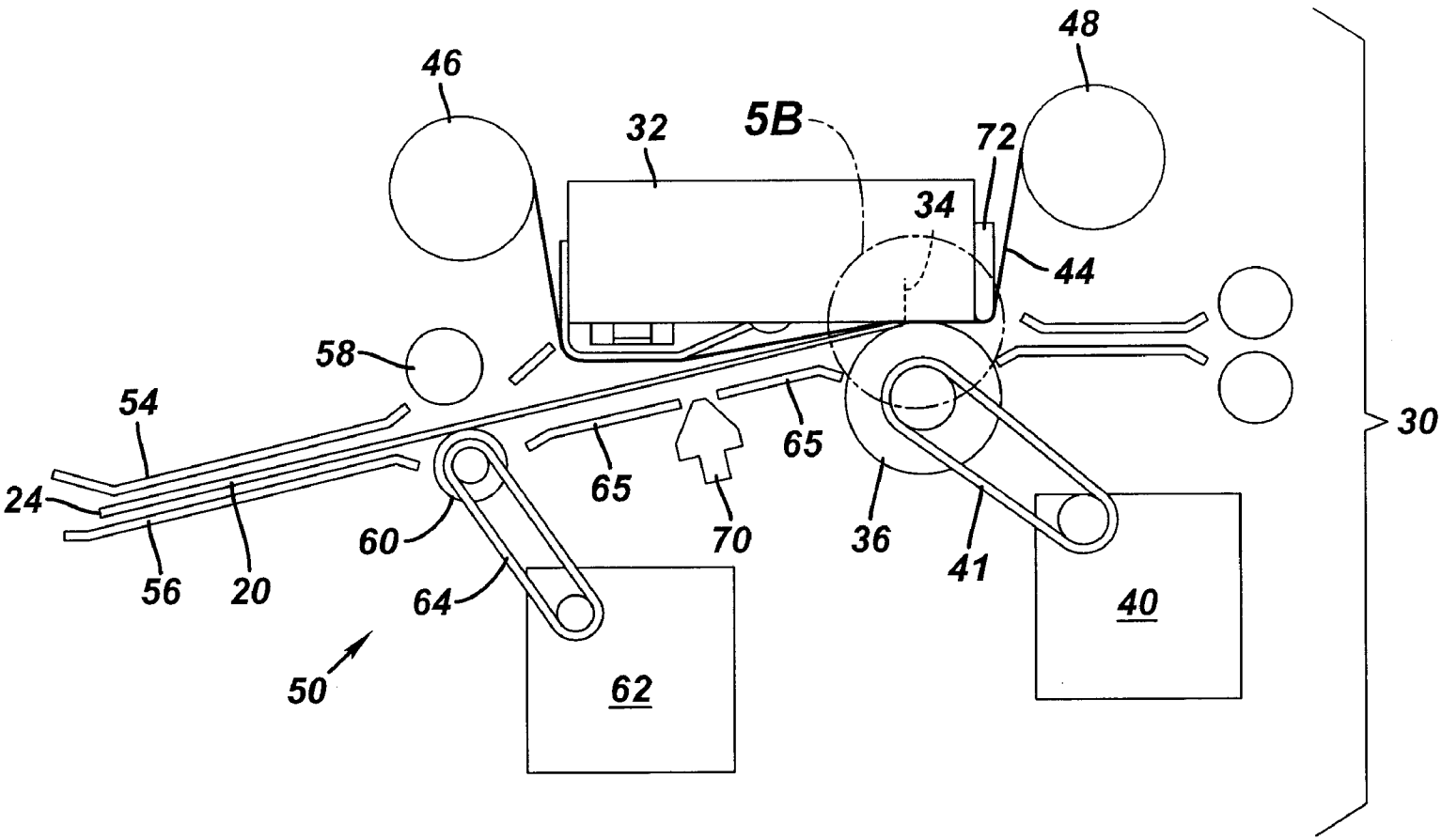
FIGS. 5A and 5B are views of the next step where the print head has moved vertically to clamp the receiver medium between the donor web and the platen with FIG. 4B showing a detail of that clamping operation.
Figure 5B:
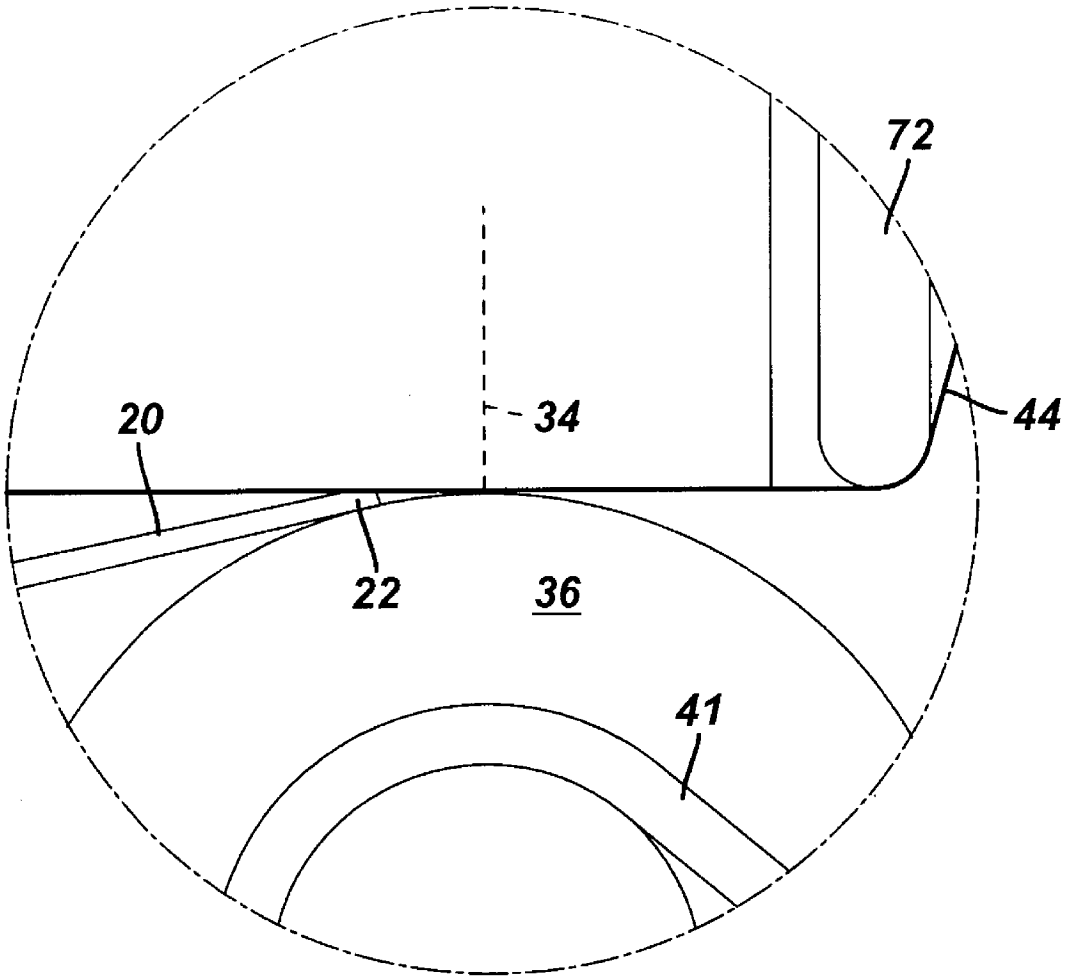
Figure 6:
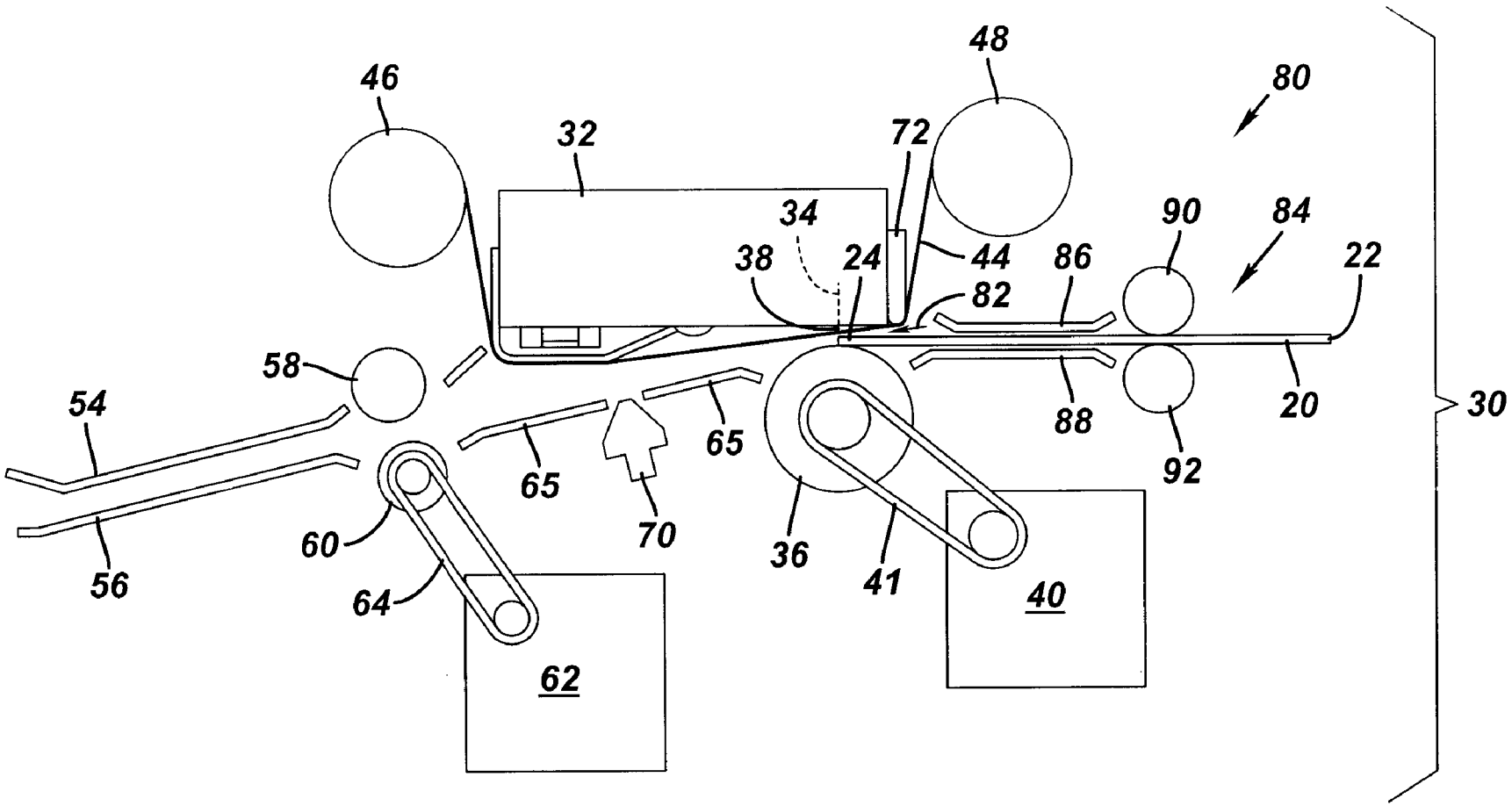
FIG. 6 shows a step of the process where the receiver medium is ejected from the apparatus.
Figure 7A:
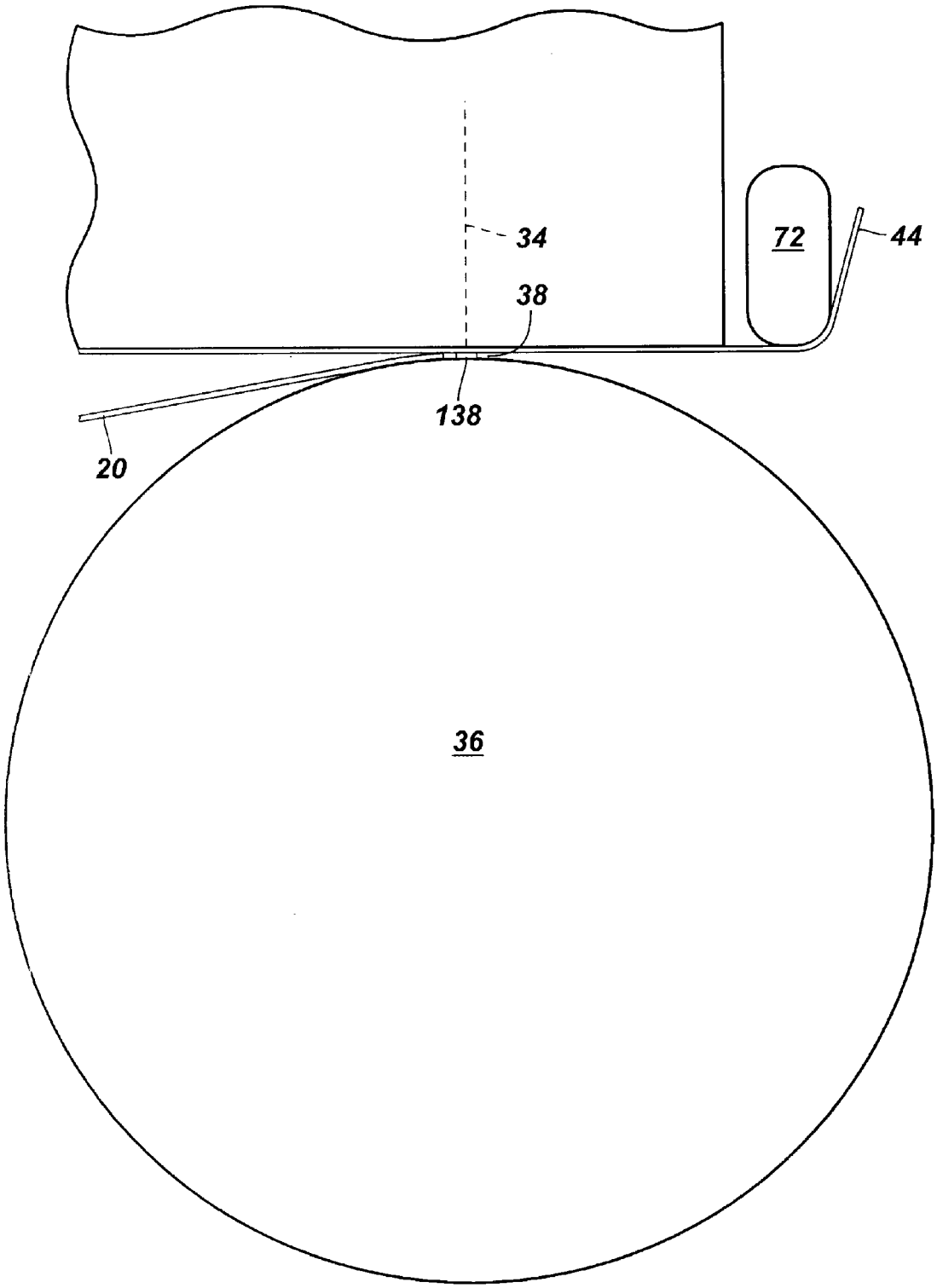
FIGS. 7A and 7B illustrate a leading web and a trailing web formed by donor adhesion.
Figure 7B:
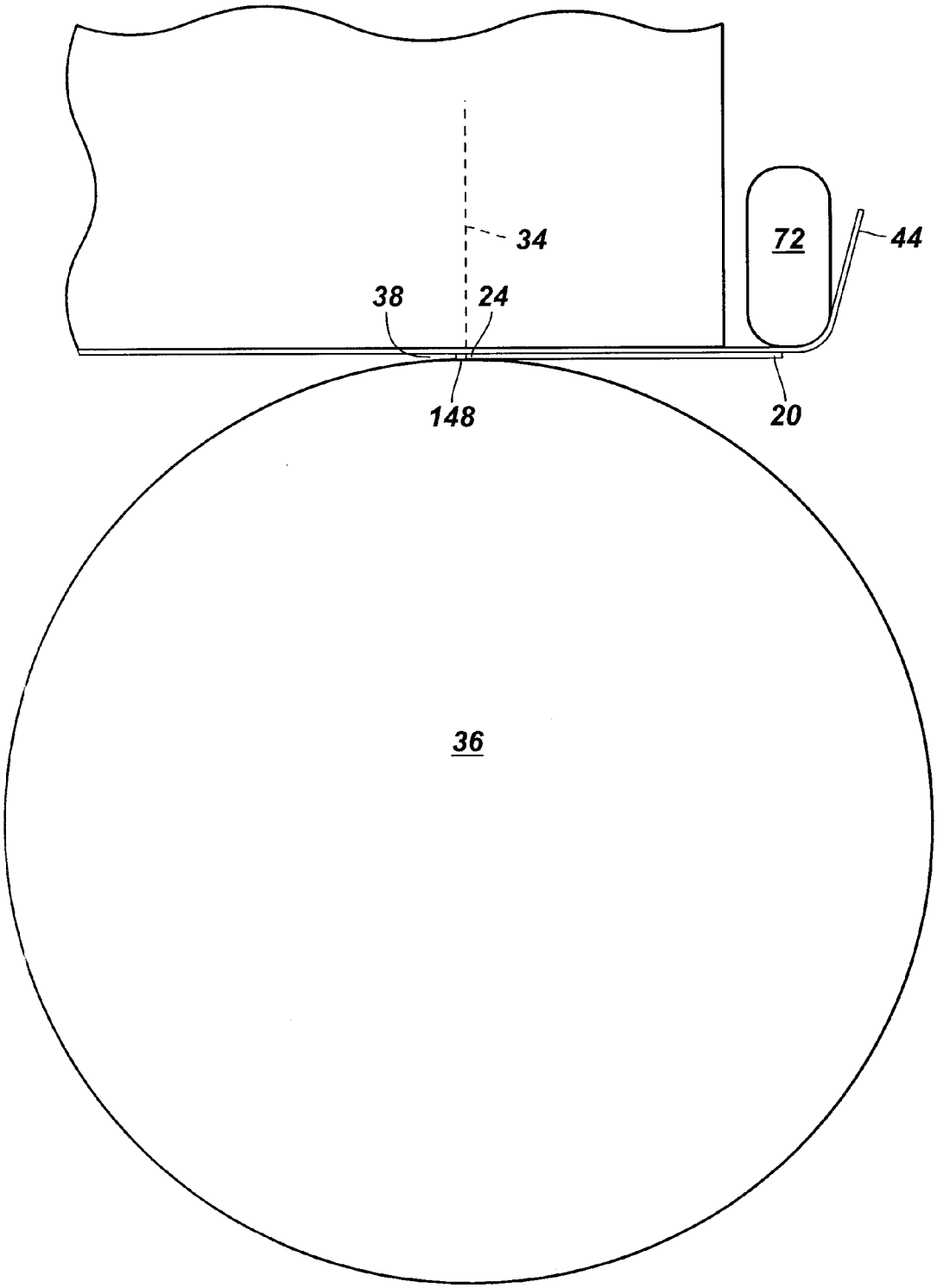
Figure 8A:
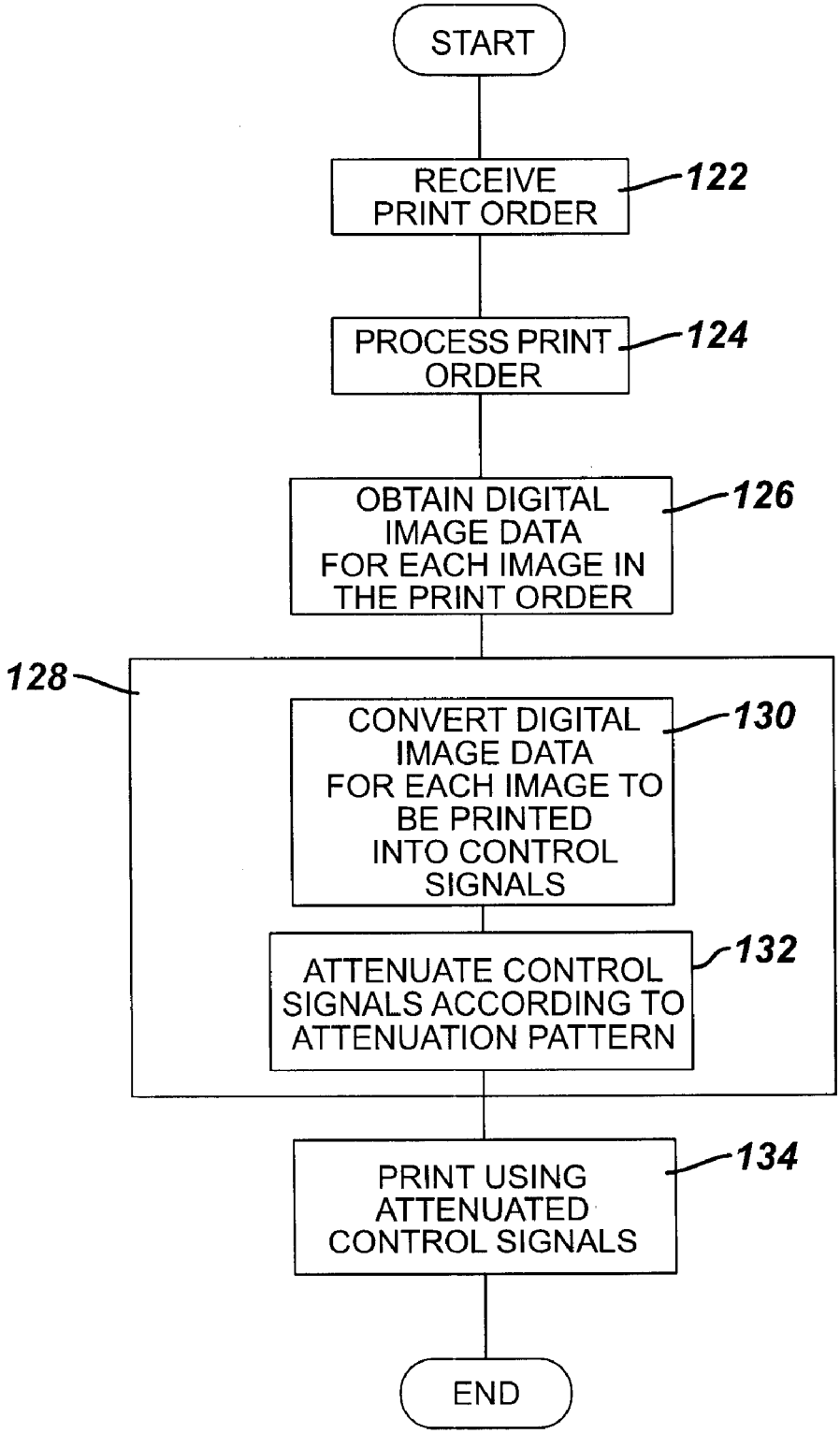
FIGS. 8A and 8B illustrate one method for operating borderless thermal printer to achieve borderless printing on a receiver medium with reduced possibility of donor adhesion problems.
Figure 8B:
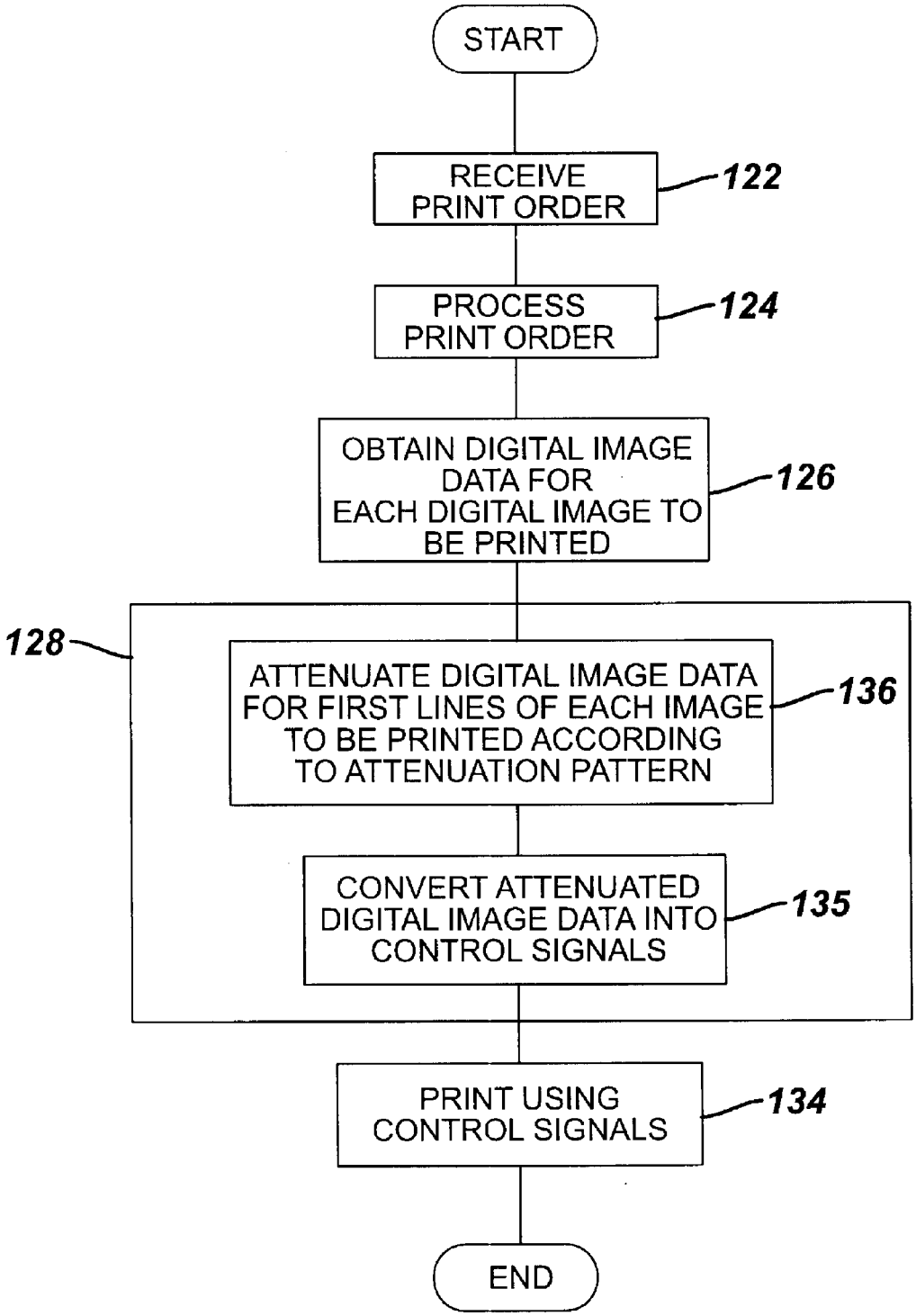

FIGS. 2-6 illustrate one embodiment of a borderless thermal printer 30, FIGS. 7A and 7B illustrate a leading web and a trailing web formed by donor adhesion, and FIGS. 8A and 8B illustrate one method for operating borderless thermal printer 30 to achieve borderless printing on a receiver medium 20 with reduced possibility of donor adhesion problems. In the embodiment illustrated, borderless thermal printer 30 has a thermal print head 32 with an array of thermal elements 34 positioned opposite a platen 36 at a printing nip 38. Platen 36 is coupled to a platen stepper motor 40 by a suitable transmission 41 such as a belt. Those skilled in the art understand that FIGS. 2-6 are schematic in nature and other suitable structure are possible for connecting platen stepper motor 40 to platen 36 in order to turn platen 36. Such other structures include and are not limited to gear trains, and transmissions. A control circuit 42 sends suitable signals to control the operation of platen stepper motor 40 in a manner that will be described in greater detail below.

The array of thermal elements 34 is adapted to heat a donor web 44 in accordance with control signals received from control circuit 42 and to heat in response thereto so that thermally transferable donor material can be transferred from donor web 44 to receiver medium 20.

Donor web 44 is supplied by a donor supply roller 46 on one side of the thermal print head 32 and collected by a donor take-up roller 48 on an opposite side of thermal print head 32. As will be discussed in greater detail below, during printing, donor web 44 travels across the array of thermal elements 34 and is wound on a donor take-up roller 48. Donor web 44 carries thermally transferable donor material such as dyes, colorants, protective coating and/or metallic or other materials. Donor web 44 can comprise a single color of thermally transferable donor material for monotone printing, but it preferably comprises at least three sequential sections of differently colored thermally transferable donor material in order to provide full-color print and a clear section for applying a protective cover on the print. In a conventional fashion, thermal printer 30 has a bias spring 53 that urges thermal print head 32 toward platen 36.

Figure 1:
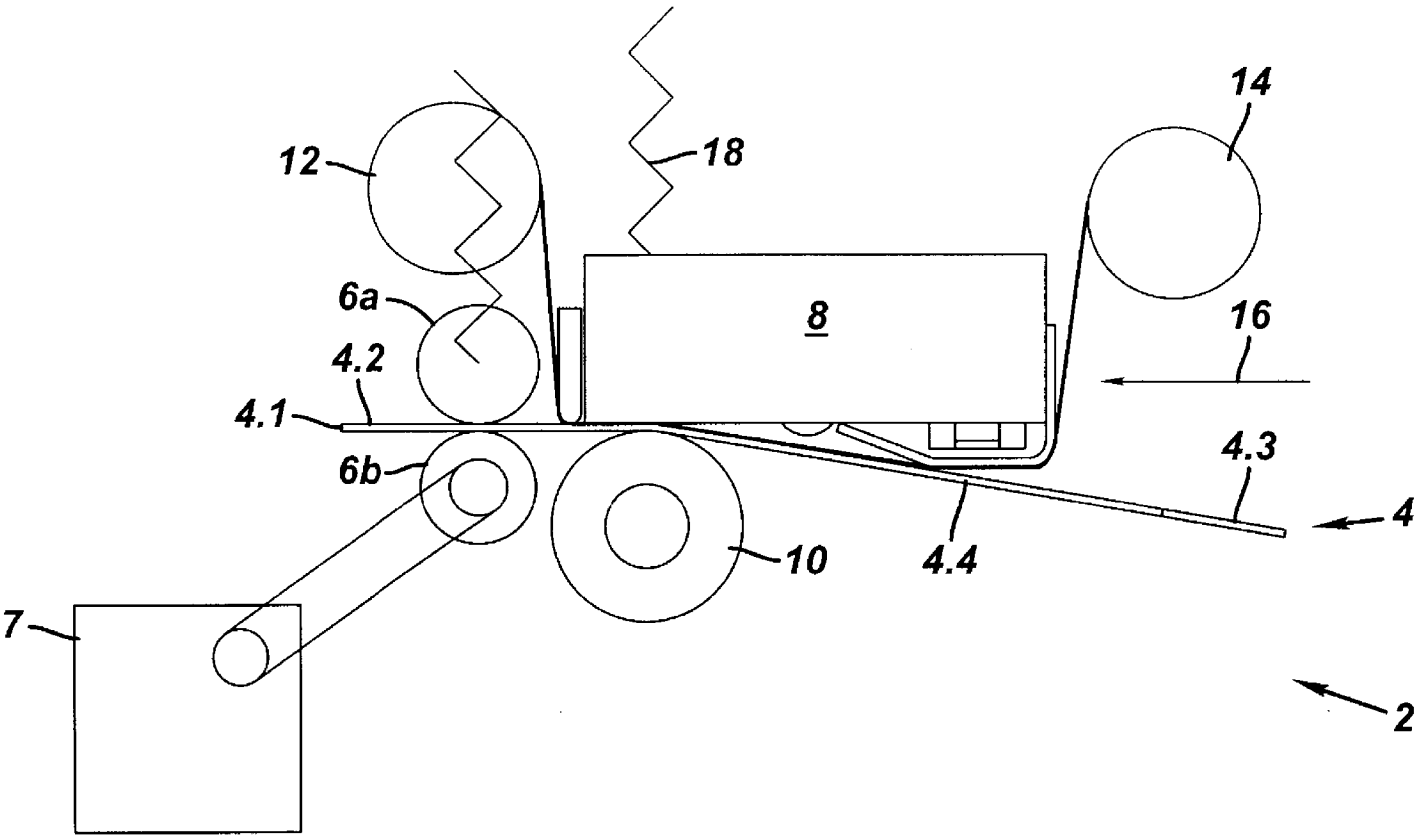
FIG. 1 PRIOR ART
FIG. 1 shows a mechanical schematic view of a prior art printer.
Figure 2:
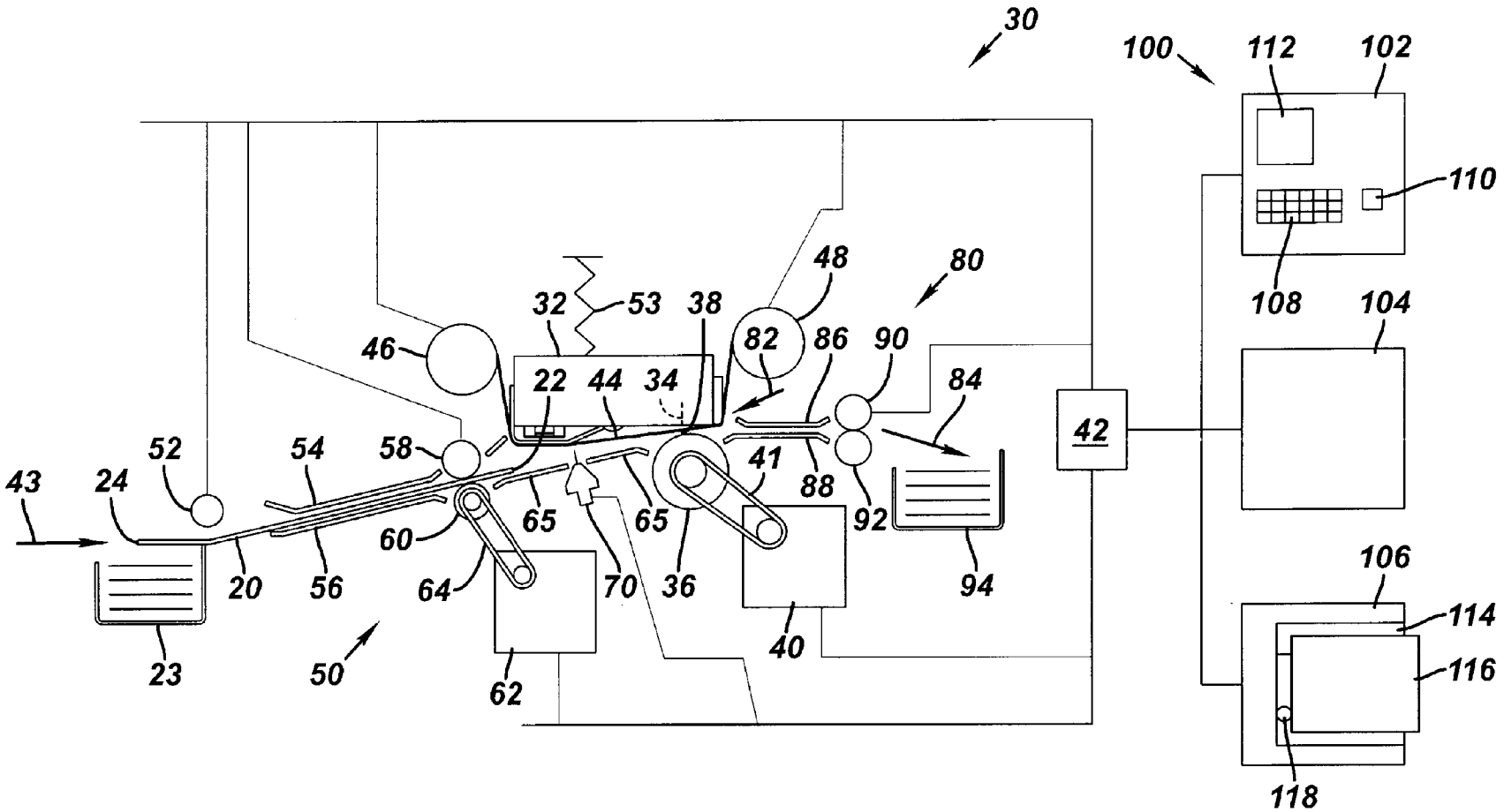
FIG. 2 is a mechanical schematic view of one embodiment of a printer.

As is shown in FIG. 2, borderless thermal printer 30 has a receiver medium advance system 50 that is adapted to move a leading edge 22 of receiver medium 20 between a loading position, for example, in receiver supply 23 and a print start position. In the embodiment of FIGS. 2-6, receiver medium advance system 50 comprises a pick roller 52, surface guides 54, 56, entrance urge rollers 58, 60, urge stepper motor 62, transmission 64, and print head guide 65.

Entrance urge rollers 58, 60 are disposed at one end of surface guides 54, 56. Entrance urge rollers 58, 60 are biased together by a suitable spring or other biasing structure, not shown, so that rotary motion imported to one roller is transmitted to the other. Entrance urge roller 58 is a pinch roller and entrance urge roller 60 is driven by an urge stepper motor 62 and a transmission 64. Transmission 64 is shown as a belt but may be any suitable transmission known in the art that can be used to connect the rotary motion of stepper motor 62 to entrance urge roller 60 including, but not limited to, a gear train or transmission. In operation, receiver medium 20 is advanced by urge rollers 58 and 60 through a nip between urge rollers 58, 60 and is then supported by print head guide 65. Print head guide 65 directs leading edge 22 to printing nip 38 as urge rollers 58 and 60 of receiver medium advance system 50 continue to advance receiver medium 20. Entrance urge rollers 58, 60 can be permanently engaged or can be selectively engaged. To selectively engage entrance urge rollers 58, 60, an entrance urge roller 58 can be spring biased away from urge roller 60 and an actuator (not shown) controlled by control circuit 42 is operable to move urge roller 58 or entrance urge roller 60 into or out of engagement with each other.

Figure 3A:
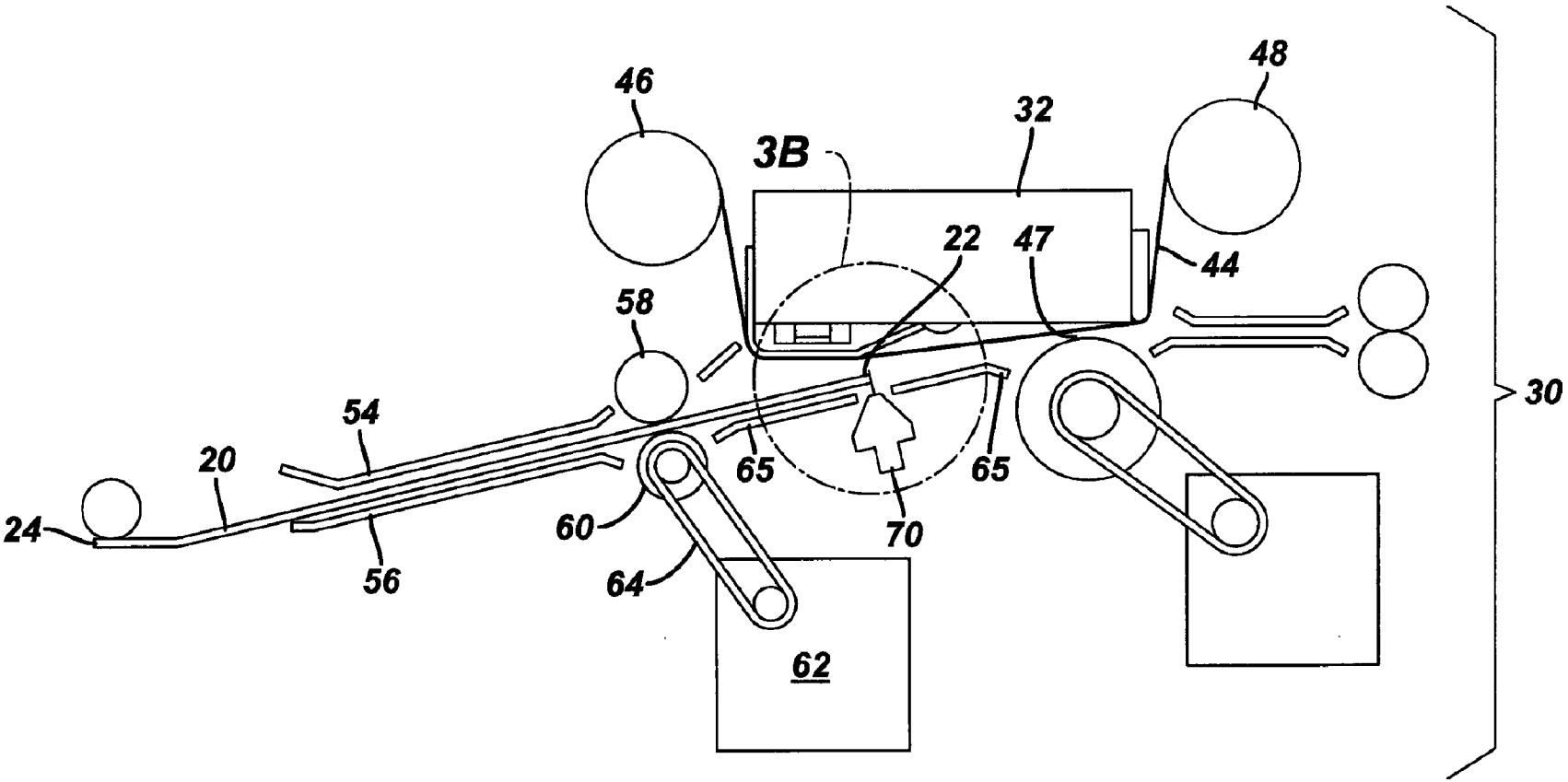
FIGS. 3A and 3B are, respectively, schematic views of the apparatus with the receiver medium aligned to a sensor and an enlarged partial view of the receiver medium and the sensor.
Figure 3B:
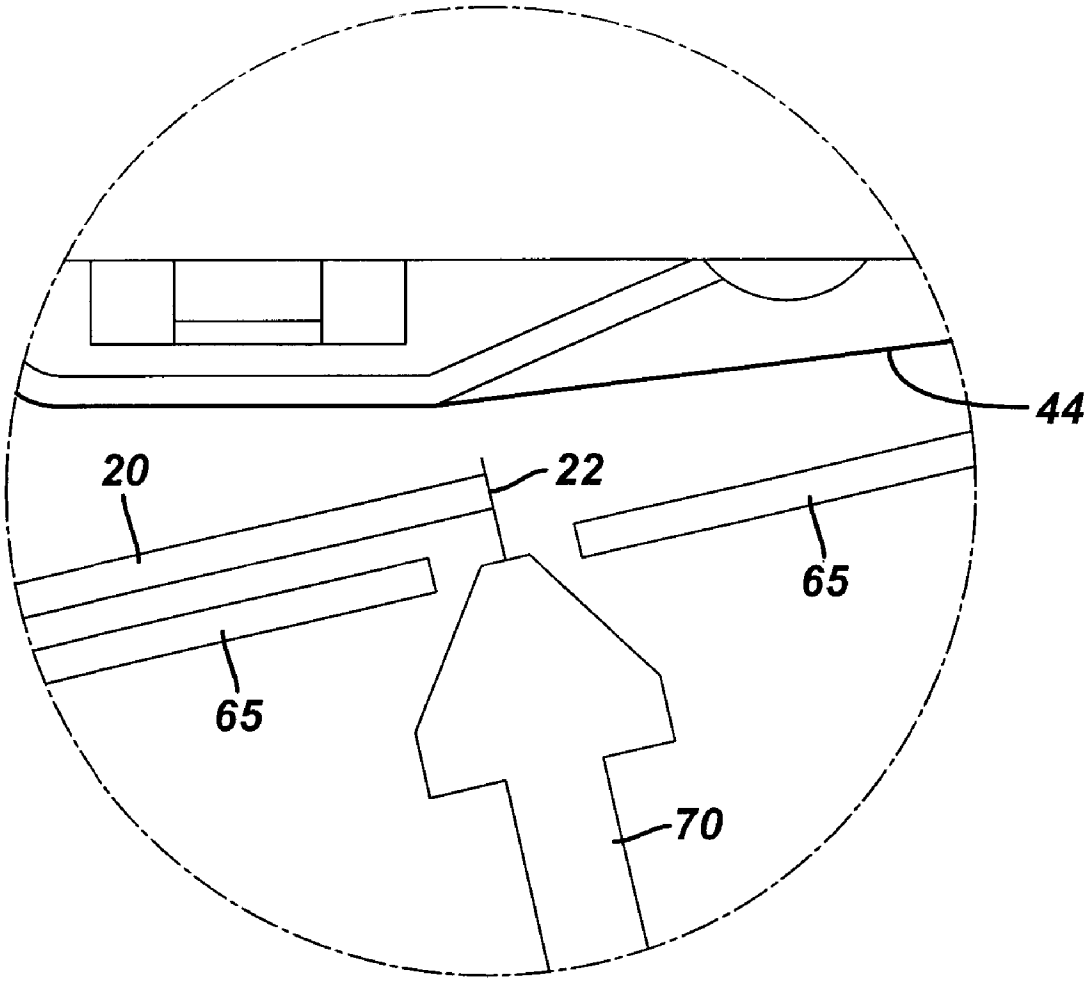

As is shown in FIGS. 3A and 3B, an edge sensor 70 is positioned relative to print head guide 65. Edge sensor 70 can be, without limitation, an optical, mechanical, electromechanical, electromagnetic or a combination of optical, mechanical, electromechanical or electromagnetic device that at least senses receiver medium 20. Edge sensor 70 is coupled to control circuit 42 and generates a sensor signal from which control circuit 42 can determine when leading edge 22 and, optionally, trailing edge 24 of receiver medium 20 are advanced through an area sensed by edge sensor 70. Any conventional edge sensor 70 can be used including a wide variety of sensors that are well-known in the printing and photocopying art. In addition, edge sensor 70 may be combined with a suitable gate (not shown) or other signal modifying, amplifying or attenuating circuits so the sensor signal is provided to control circuit 42 in a manner that is readily usable thereby. Those skilled in the art understand that in this embodiment receiver medium 20 has its lateral sides aligned and deskewed so that leading edge 22 of receiver medium 20 is transverse to a path 43 of travel and is substantially aligned parallel to the linear array 34.

Figure 4A:
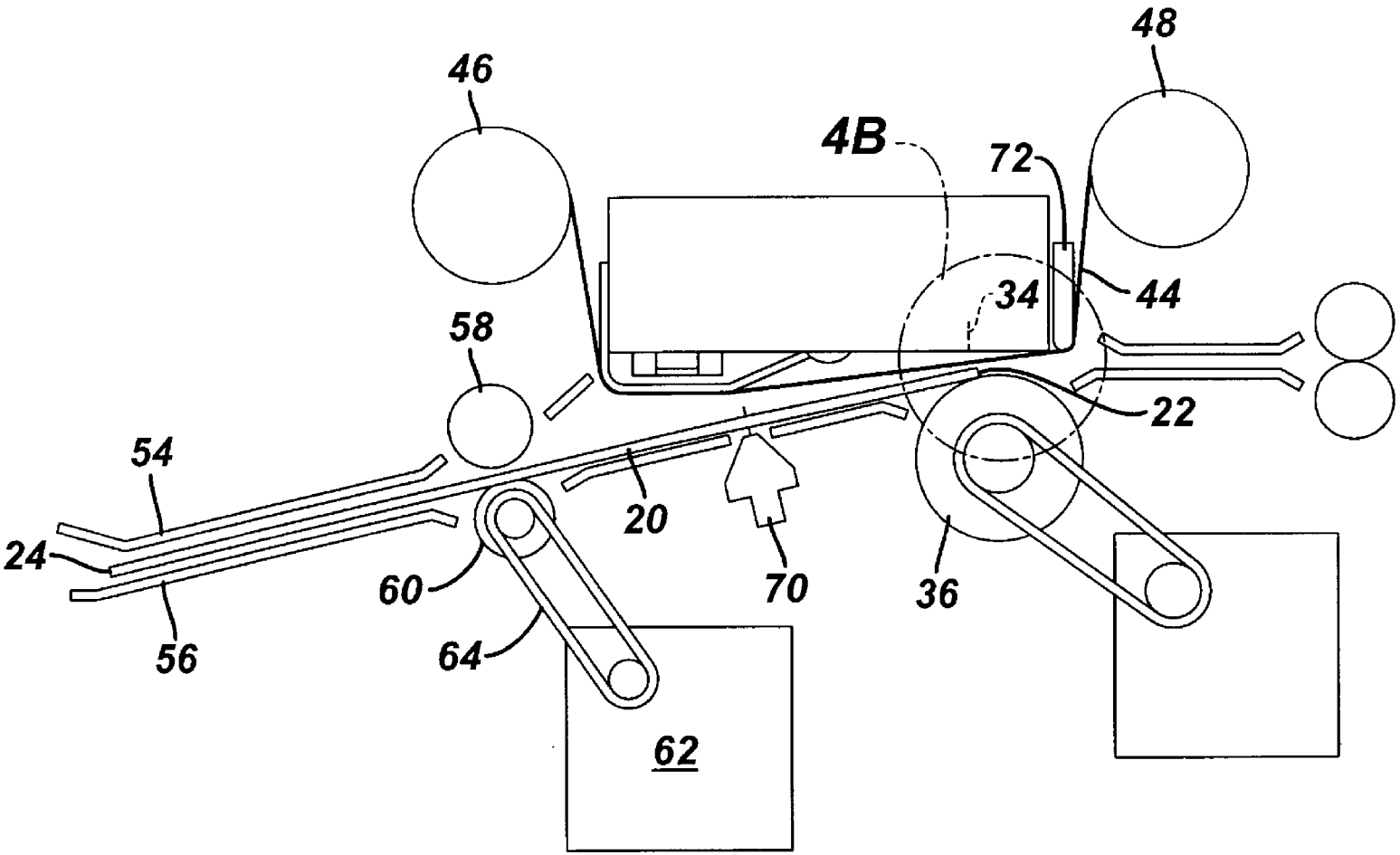
FIGS. 4A and 4B are, respectively, views of the next step where the receiver medium is driven to an initial position proximate the heat/print line or the print head including an enlarged partial view of the initial position.
Figure 4B:
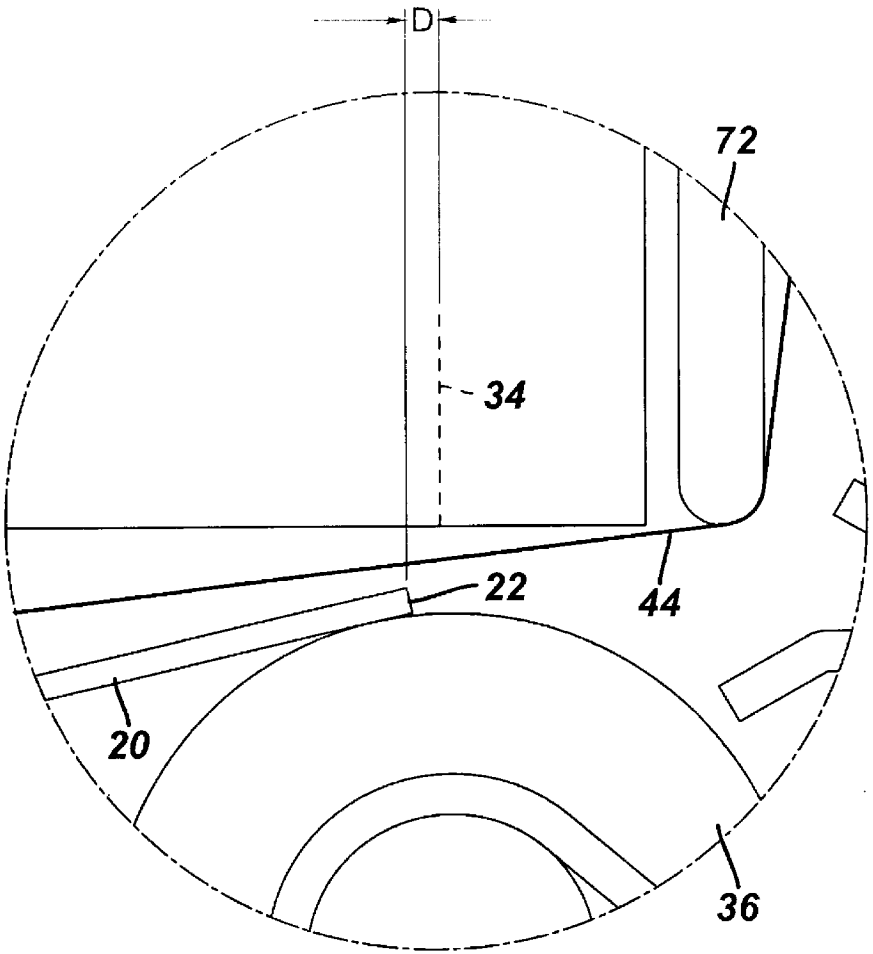

As is shown in FIGS. 4A and 4B, when edge sensor 70 generates a signal indicating that leading edge 22 of receiver medium 20 has been detected, control circuit 42 drives urge stepper motor 62 a predetermined number of steps. This causes urge rollers 58, 60 to drive receiver medium 20 toward array of thermal elements 34 and to stop receiver medium 20 with its leading edge 22 at an initial position that is a distance D from the array of thermal elements 34. The initial position is close enough to array of thermal elements 34 so that leading edge 22 of receiver medium 20 will be captured between thermal print head 32 and platen 36. In FIG. 4B, leading edge 22 of receiver medium 20 is shown at location D that is approximately 0.020 inches (0.0368 cm) from the array of thermal elements 34, however, the separation can be greater or lesser as desired.

After receiver medium 20 is in the initial position, control circuit 42 causes a motor (not shown) to drive thermal print head 32 downward in the direction of arrow 53 in order to clamp receiver medium 20 and donor web 44, between thermal print head 32 and platen 36, as is shown in FIGS. 5A and 5B. With receiver medium 20 in the initial position, control circuit 42 actuates platen stepper motor 40 such that receiver medium 20 and donor web 44 driven past array of thermal elements 34, while array of thermal elements 34 are energized in an imagewise fashion so as to transfer thermally transferable donor material from donor web 44 to receiver medium 20 to record an image on receiver medium 20.

As shown in FIG. 6, after receiver medium 20 passes array 34, a peel plate 72 sharply alters the direction of donor web 44 relative to receiver medium 20 to separate donor web 44 from receiver medium 20 as receiver medium 20 continues to travel in generally the same direction or until it is redirected in another direction. In one embodiment, receiver medium 20 can continue such travel along an exit path that causes receiver medium 20 to pass out of printer 30 as a completed printed image.

In the embodiment illustrated, receiver medium 20 passes into a receiver medium return system 80 after donor web 44 is separated from receiver medium 20. Receiver medium return system 80 comprises an arrangement of guides, gates, rollers or other structures that is responsive to control circuit 42 and that can direct receiver medium 20 along a return path 82 that returns receiver medium 20 to a position that allows receiver medium advance system 50 to reload receiver medium 20 so that additional images can be printed thereon or to an exit path 84.

As shown in the embodiment of FIGS. 2-6, receiver medium return system 80 comprises exit guides 86, 88 which lead receiver medium 20 from printing nip 38 and into the nip of exit urge rollers 90 and 92. Exit urge rollers 90 and 92 are likewise driven to rotate by an actuator (not shown) that is under control of control circuit 42. Exit urge rollers 90 and 92 are operable to rewind and feed receiver medium 20 back toward urge rollers 58, 60. This can be done to rewind receiver medium 20 so that it is reloaded for a second printing, for example, to enable multicolor printing and/or laminating. In other embodiments, a return system 80 can provide a recirculating type return path (not shown) that guides leading edge 22 from exit urge rollers 90, 92 to entrance urge rollers 58, 60 without passing receiver medium 20 through printing nip 38. A wide variety of recirculating return paths of this type are known in the printing, scanning, and photocopying arts. Examples of such recirculating return paths are illustrated in, for example, co-pending U.S. application Ser. No. 11/176,147 entitled "Printer with Multi-Pass Media Transport" filed by Cloutier et al. on Jul. 7, 2005; or U.S. Pat. No. 5,838,357 to Maslanka et al., issued Nov. 17, 1998, entitled "Thermal Printer Which Uses Platen to Transport Dye Donor Web Between Successive Printing Passes"; U.S. Pat. No. 5,798,783 to Maslanka et al., issued Aug. 25, 1998, entitled "Thermal Printer with Sensor for Leading Edge of Receiver Sheet"; U.S. Pat. No. 5,841,460 to Maslanka et al., issued Nov. 24, 1998, entitled "Thermal Printer which Recirculates Receiver Sheet Between Successive Printing Passes"; and U.S. Pat. No. 5,850,246 to Maslanka et al., issued Dec. 15, 1998, entitled "Thermal Printer with Improved Print Head Assembly". After printing is completed, control circuit 42 sends signals to an actuator (not shown) that cause exit urge rollers 90, 92 discharge receiver medium 20 along an exit path 84 into a discharge bin 94, as shown in FIG. 2.

It will be appreciated that receiver medium advance system 50 provides relatively precise location of leading edge 22 of receiver medium 20 in that edge sensor 70 can sense leading edge 22 of receiver medium 20 with a great deal of accuracy and in that stepper motors can be used to precisely drive sets of exit urge rollers 90, 92 and platen 36 to move receiver medium 20 by an initial amount from the detected position. In this way, thermal-dye transfer material may be transferred from leading edge 22 of receiver medium 20 to trailing edge 24 of receiver medium 20. However, it will be understood that in other embodiments, any other conventional system known for positioning a receiver medium 20 proximate to an array of thermal elements 34 can be used.

It will also be appreciated, however, that even with the most precise placement of leading edge 22, minor variations in the length of receiver medium 20, the receiver medium advance system 50 used to position receiver medium 20 for printing, platen 36, transmission 41 or platen stepper motor 40, or in the equipment used to sense the position of the receiver medium can cause receiver medium 20 to be positioned at the start of printing such that multiple lines of thermal donor material will be printed before leading edge 22 of receiver medium 20 enters printing nip 38 between thermal elements 34 of thermal print head 32 and platen 36, thus creating a risk of thermal adhesion of the thermally transferable donor material to platen 36. As is conceptually illustrated in FIG. 7A, this can cause a section of thermally transferable donor material to be transferred to platen 36 at the start of printing creating a leading edge web 138 of molten, semi-molten or form of donor transfer material between platen 36 and donor web 44 which either interferes with the movement of receiver medium 20 as it enters printing nip 38 by blocking movement of receiver medium 20 through printing nip 38 or creates unintended image artifacts in an image printed using receiver medium 20. Similarly, the same factors can cause printing to continue after all of receive medium 20 has passed through printing nip 38, forming a trailing web 148 between donor web 44 and platen 36, which can create similar interference or image artifacts.

To avoid these outcomes a thermal printer 30 and method for operating a thermal printer 30 are provided that can reduce the possibility of thermal donor adhesion, such as might cause a leading edge web 138 to form while still providing borderless prints.

FIG. 8 illustrates one embodiment of a method for operating the borderless thermal printer 30 of FIGS. 2-6 to reduce the possibility of thermal donor adhesion. As is illustrated in FIG. 8, the printing process begins when thermal printer 30 receives a print order from an interface 100 (step 122). The print order provides instructions sufficient for control circuit 42 to begin a print sequence and can include an instruction to print an image, the image data for the image to be printed, print quantity information or information identifying a selected receiver medium 20 upon which the image is to be printed. The print order can also contain other information including but not limited to as delivery date, delivery destination information, consumer information, and point of sale information.

Interface 100 can incorporate any known circuits or systems that are capable of receiving a print order or data forming part of the print order. By way of example, and not limitation, in the embodiment illustrated in FIGS. 2-6, interface 100 has a user input system 102, a communication system 104, and a memory reader 106 that can be used for obtaining information forming all or at least a part of a print order.

User input system 102 can comprise any form of transducer or other device capable of receiving an input from a user and converting this input into a form that can be used by control circuit 42. For example, user input system 102 can comprise a touch screen input, a touch pad input, a 4-way switch, a 6-way switch, an 8-way switch, a stylus system, a trackball system, a joystick system, a voice recognition system, a gesture recognition system or other such systems. In the embodiment illustrated in FIG. 2, user input system 102 includes a keypad 108 and mouse 110 for receiving input from a user. A display 112 is connected to control circuit 42 and provides information and feedback to the user to facilitate user input actions and for other purposes.

Communication system 104 is adapted to enable communications between thermal printer 30 and an external devices, networks and systems. Examples of such external devices include but are not limited to local, regional and international data and telecommunication networks, computers, databases, printers, cameras, cellular phones, personal digital assistants, internet appliances, the internet and any associated devices, televisions, assistive technology devices and any other communication, data or other devices that can be used to generate, process, edit, distribute or otherwise send or receive data that can be related to a print order or other function that is performed by thermal printer 30.

Communication system 104 can be for example, an optical, radio frequency or transducer circuit or other system that converts image and other data into a form that can be conveyed to such external devices such as a remote memory system by way of an optical signal, radio frequency signal or other form of signal. Communication system 104 provides control circuit 42 with information and instructions from signals received thereby.

In the embodiment of FIGS. 2-6, memory interface 118 comprises a memory card slot 114 that holds a removable memory 116 such as a removable flash card or other form of memory card or memory device and has a removable memory interface 118 for communicating with removable memory 116. Data including but not limited to control programs, digital images and metadata can also be stored in a remote memory system. In other embodiments, removable memory 116 can take other forms such as, a removable optical, magnetic or other disk memory (not shown).

Each print order generally provides information from which control circuit 42 can determine what images are to be printed, how the images are to be printed and the quantity of each of the images that is to be printed. A print order can be associated with digital image data representing the image to be printed and instructions for printing such an image. However, other print orders can be associated with digital image data by providing reference information instead of digital image data with the reference information being useable by control circuit 42 to obtain digital image data from an external source such as by using communication system 104 or memory interface 118. In some cases, the printing instructions can be provided in the form of digital print order format (DPOF) data that allows a user of a digital camera or other type of display device to define which of a set of stored images are to be printed, and can also provide information that identifies number of copies or other image information that can be used in fulfilling a print order.

Control circuit 42 processes the print order data to determine what images to print and in what manner. In this regard, control circuit 42 processes non-image data in the print order to determine factors such as quantity information, print type information, enlargement or reduction factors, collation information and the like (step 124).

Control circuit 42 then obtains digital image data for each image in the print order (step 126). As is noted above, such image data is typically transmitted with the print order data and can be obtained therefrom. In certain circumstances, the print order data provides information indicating how the digital image data can be obtained, such as by providing address and, optionally, access information, allowing such data to be downloaded from a removable memory 116 or from a source connected to borderless thermal printer 30 by way of communication system 104.

Control circuit 42 then determines control signals that are adapted to cause thermal printer 30 to print borderless images on receiver medium 20. To do this control circuit 42 generates control signals for array of thermal elements 34 that cause the array of thermal elements 34 to radiate heat as necessary to cause donor material to transfer from donor web 44 to receiver medium 20 to form a printed image on the receiver medium 20. Typically, such control signals are based upon the image data for the image to be printed and any print order data indicating a print size, shape or orientation, and include control signals enabling the printing of an image having a longitudinal length that is longer than a longitudinal length of the receiver medium. For the purposes of the examples herein it will be assumed that the print order calls for a borderless printing of a single image.

As is noted above, to ensure that such borderless printing occurs, receiver medium 20 is positioned with a leading edge 22 separated from printing nip 38 by a distance D, thus allowing printing to begin just before leading edge 22 reaches nip, so that it is certain that leading edge 22 will receive donor material deposited in an imagewise fashion.

However, as is illustrated in FIG. 7A, this creates a risk that donor material will be applied to platen 36 in a fashion that allows such donor material to adhere to platen 36 and create leading edge web 138 of molten and/or semi-molten donor material between platen 36 and donor web 44. Where such a leading edge web 138 is formed from a substantial amount of donor material, web 138 can impede or block receiver medium 20 from passing through printing nip 38 or can create unwanted image artifacts. Accordingly, in the embodiments described a step of forming attenuated control signals (step 128) comprises forming such signals in accordance with an attenuation pattern that reduces the amount of or density of thermal donor material to minimize the risk of forming a type of leading edge web 138 that can impede or block the transit of receiver medium 20 through printing nip 38.

In the embodiment of FIG. 8A, control circuit 42 performs step 128 by first converting the digital image data into control signals that can be used by thermal print head 32 (step 130) and then attenuating the control signals according to an attenuation pattern (step 132).

In this embodiment, this step of converting the digital image data into control signals (step 130) involves converting the digital image data into printer code values or other data types that represent specific colors to be printed on receiver medium 20 to form an image. This is typically done in accordance with so-called calibration information that provides a logical association between the colors called for in the image data and printer code values that are assumed to cause such colors to be printed by thermal print head 32. Such calibration information can also include information that printer 30 can use in determining printing actions to be taken in response to particular code values.

The calibration information can be predetermined using calibration data that is established during an initial set up phase at a manufacturer's facility or elsewhere. However, because many aspects of printing, particularly color printing, are influenced by environmental conditions, printing process variations, and donor and receiver material variations, it is understood that, from time to time, it may be useful to recalibrate the initial printer settings to ensure that the colors that are printed correspond to colors called for in the print data. Accordingly, the process of converting digital image data into code values can adapt to such conditions by recalibrating printer settings according to feedback from using sensors that monitor such conditions, feedback from sensors that monitor the colors printed in response to particular code values or using manual feedback systems.

During printing, the code values are converted into control signals which govern the extent to which thermal elements in array 34 are energized. The thermal elements of array 34 radiate heat in proportion to the extent to which they are energized and the thermal donor material transfers from donor web 44 in proportion to the amount of heat applied thereto. Accordingly, in a conventional thermal printer, an image is formed using the thermal donor materials by supplying control signals to the thermal print head 32 as the donor web 44 and receiver medium 20 are moved by the platen to advance the receiver sheet and the donor web past array of thermal elements 34.

In the embodiment illustrated in FIG. 8A, the control signals are generated on a line by line basis and, during printing, control circuit 42 transmits a first line of control signals, then control circuit 42 transmits signals to platen stepper motor 40 causing platen stepper motor 40 to rotate in a manner that advances platen 36 by a distance that is intended to position receiver medium 20 so that the array of thermal elements 34 can print a second print line. Control circuit 42 then sends a second line of control signals to array of thermal elements 34. Printing continues in this manner until all print lines for the image have been printed.

However, in the embodiment of FIG. 8A, before the image based control signals are used for printing, control circuit 42 attenuates the control signals to lower the density of the printing according to an attenuation pattern.

Figure 9:
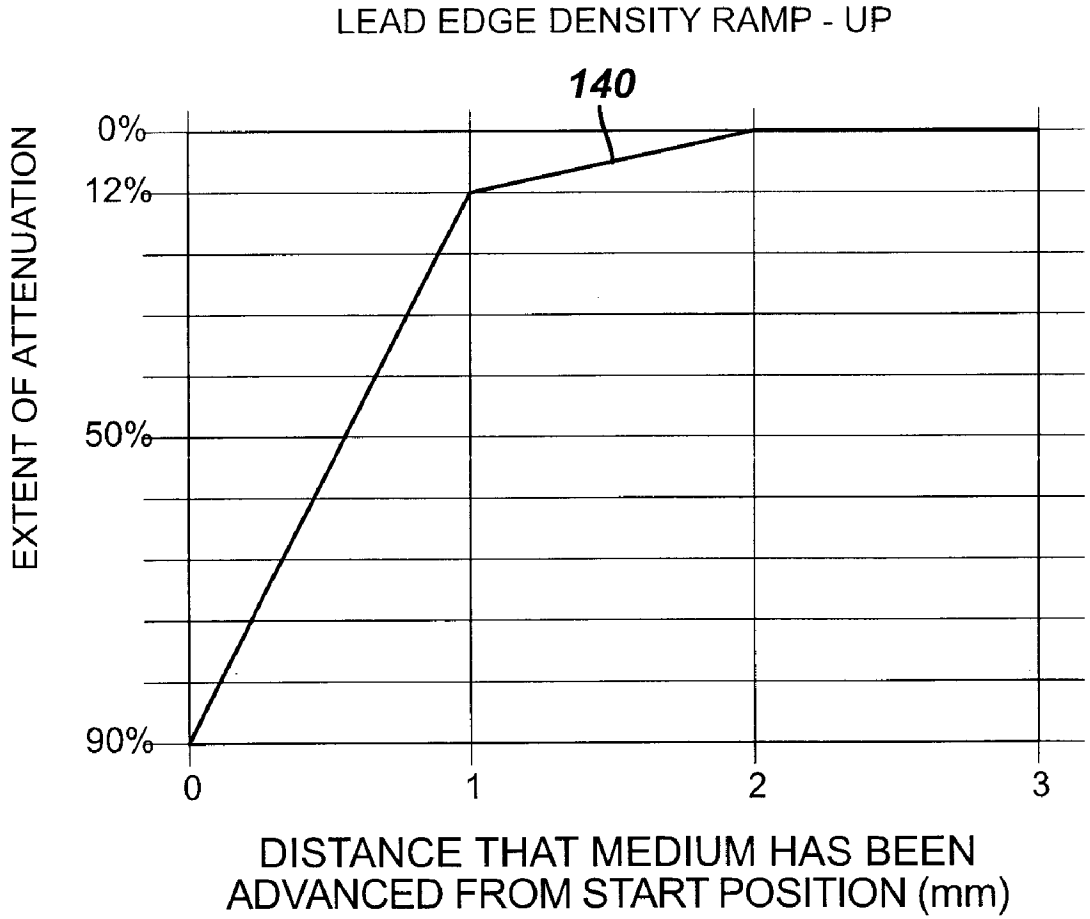
FIG. 9 shows one embodiment of an attenuation pattern.

FIG. 9 illustrates one embodiment of this attenuation pattern 140. In the attenuation pattern of FIG. 9, the extent of attenuation indicated by attenuation pattern 140 is relatively high during a first few lines of printing and can be as high as 90% or more in during these lines, however, the extent of attenuation is decreased as additional steps are taken. This reflects, in a general way, the probability that leading edge 22 of receiver medium 20 will be positioned in printing nip. More specifically, it will be appreciated that, a borderless thermal printer 30 using receiver medium advance system 50 that anticipates positioning receiver medium 20 with a leading edge 22 separated from printing nip 38, it is unlikely that leading edge 22 will be positioned at printing nip 38 when the first line of the image is printed. Thus, the attenuation is greatest at the first line of printing of the image and is reduced as printing continues.

However, with each step that platen stepper motor 40 causes platen 36 to take, it becomes more likely that leading edge 22 of receiver medium 20 will enter printing nip 38. Accordingly, attenuation pattern 140 provides a density decreasing the extent of attenuation with the extent of urging supplied by platen 36 and platen stepper motor 40 until the extent of the attenuation reaches to a minimum level of attenuation, shown in FIG. 9 as a 0% level of attenuation. It will be appreciated that using such an approach ensures that even where some donor material is transferred onto platen 36 during the first line(s) of printing, the amount of donor material transferred will be minimized so that, if necessary, leading edge 22 can be thrust through leading edge web 138 by the action of platen 36 to avoid blockage and with minimal risk of unwanted image artifacts.

The attenuated control signals are then used for printing as generally described above (step 134).

In the embodiment of FIG. 8B, control circuit 42 performs step 128 by attenuating the digital image data for the image to be printed according to an attenuation pattern (step 136) and then converts the attenuated digital image data into attenuated control signals that can be used by thermal print head 32 (step 138). In this embodiment, the step of attenuating the digital image data comprises determining which portions of the digital image data represent portions of the image that will be printed during the first few lines of printing and adjusting the density of the colors called for in those lines according to the attenuation pattern. The attenuated image data is converted to create attenuated control signals in the same fashion that is used to convert any form of digital image data into control signals, such as the fashion described above with respect to step 130.

Figure 10:
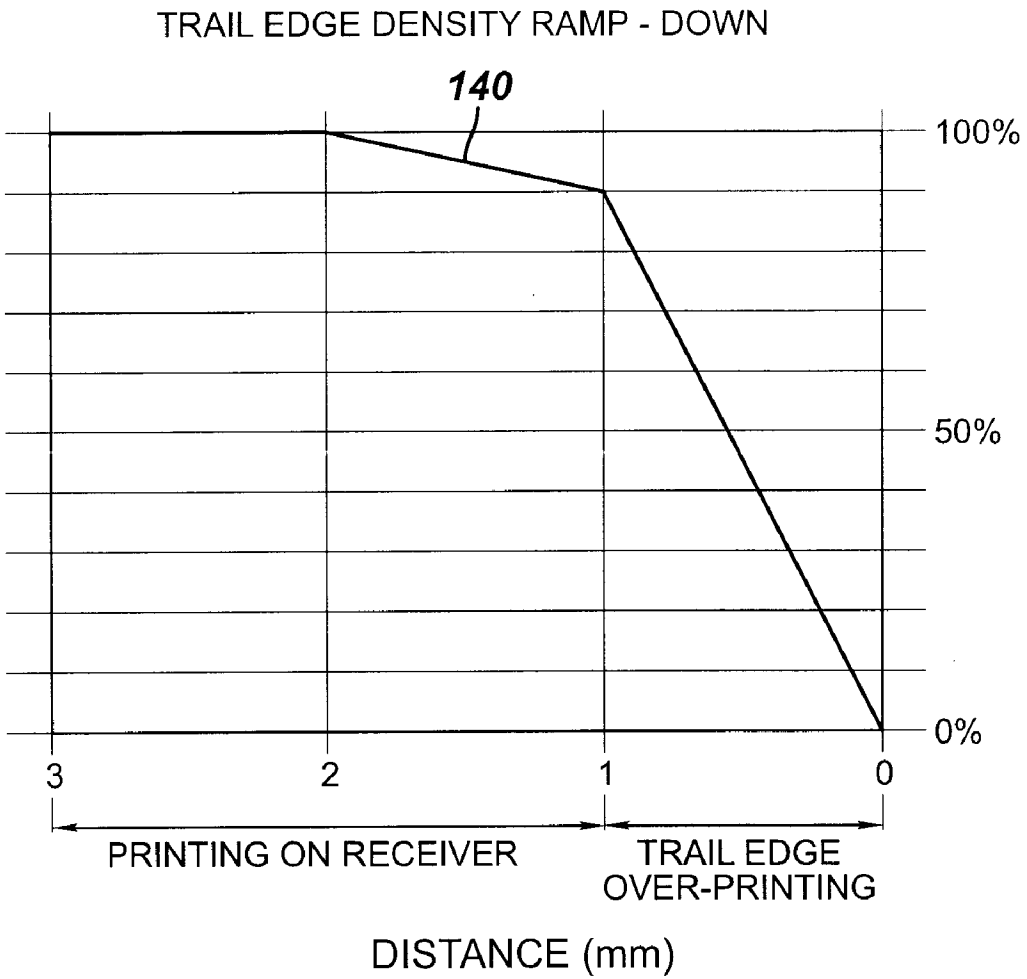
FIG. 10 shows another embodiment of an attenuation pattern.

It will also be appreciated that, in order to ensure that a digital image is printed at a trailing edge 24 of receiver medium 20, it is useful to continue printing the image data such that it can be anticipated that printing of the image will continue so that all portions of receiver medium 20, of any length or that is positioned within any range of positions relative to the initial position, will be printed. Thus, there exists a possibility that a trailing web 148 of donor material can be formed between platen 36 and donor web 44 under certain circumstances. This can interfere with the movement of subsequent receiver mediums through printing nip 38. Accordingly, attenuation pattern 140 can provide for a trailing edge density ramp down, such as is illustrated in FIG. 10, during which the control signals are attenuated in an increasing fashion to reach a relatively high level of attenuation as the printing of the image nears an end. This density ramp down can be initiated when control circuit 42 receives signals from edge sensor 70 indicating that trailing edge 24 has passed edge sensor 70 or at some predetermined number of steps of movement of receiver medium 20 after trailing edge 24 has passed edge sensor 70.

Here too, attenuation pattern 140 is generally based upon the probability that a particular line will be printed with no receiver medium 20 positioned at printing nip 38. As this probability increases, the extent of the density ramp down is increased. Printing is then performed using the attenuated control signals (step 132).

The attenuation patterns, illustrated in FIGS. 9 and 10, are exemplary only and a wide variety of other attenuation patterns may be used. A variety of factors can be used to determine an attenuation pattern for a material.

Figure 11:
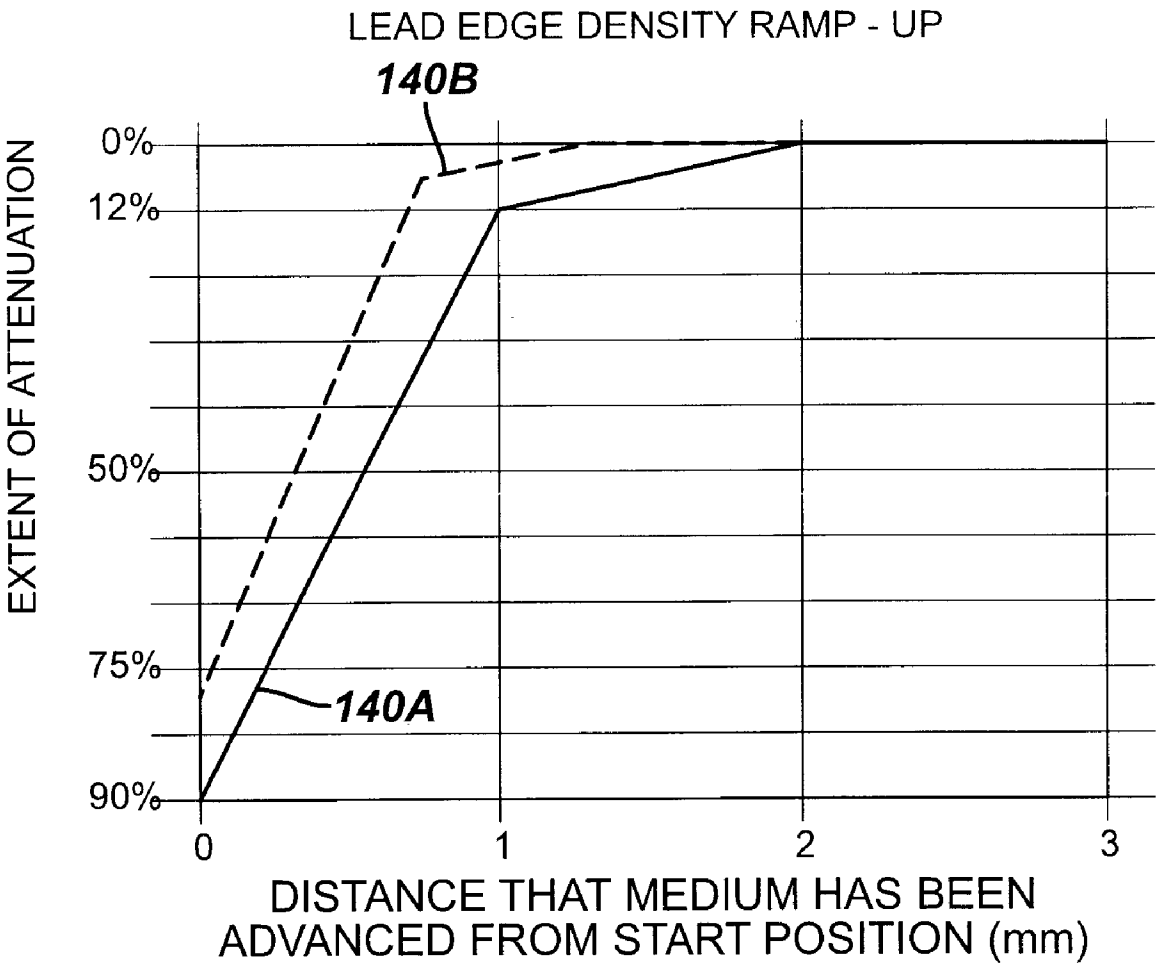
FIG. 11 shows another embodiment of an attenuation pattern.

For example, and without limitation, it will be appreciated that different types of donor material may exhibit different tendencies to form a leading edge web 138 or a trailing web 148. Donor material that has a tendency to deposit more material per level of heat applied may have a propensity to form a leading edge web 138 or a trailing web 148 at lower temperatures than a donor material that has a tendency to deposit less material per level of heat applied. For example, in color printing where donor web 44 carries a plurality of different types of differently colored donor material, a darker color may comprise donor material that is denser or that applies more donor material than a lighter colored material. Similarly, donor material that has metals in it may be denser than donor material that does not have metals in it. In such cases, an attenuation pattern 140*a*, such as the one illustrated in FIG. 11, can be used for the donor material that deposits more material per level of heat applied, while a different attenuation, pattern 140*b*, is used for donor materials that deposit less donor material per unit area. As can be seen, attenuation pattern 140*a* provides a greater extent of attenuation as well as a more gradual rate of attenuation ramp down.

It will be appreciated that other factors related to donor material type can also have a similar influence, such as a known viscosity or cooling rate of the donor material, inherent adhesive properties if any of the donor material, the type of material used to support donor material on donor web 44, or any other known materials or properties of donor web 44 or the donor material thereon. Properties of platen 36, such as cooling rate, adhesion characteristics, the shape and size of platen 36, and other factors, may also influence the attenuation pattern.

Further, it will be appreciated that during printing different environmental conditions can increase probability of forming a leading edge web 138 or trailing web 148 that impede or block the transit of receiver medium 20. For example, when platen 36 is colder, donor material can cool faster and is more likely to adhere to platen 36 in a manner that creates problems. In contrast, when platen 36 is warmer there is less likelihood of such adhesion, accordingly as shown in FIG. 12, where it is determined that platen 36 is or should be warm such as where a temperature sensor (not shown) indicates that platen 36 is warm or when there have been a significant number of printed images within a period of time to warm platen 36, attenuation patterns 140*a* and 140*b* can be adjusted, to allow for lesser or greater attenuation based upon such factors.

Figure 12:
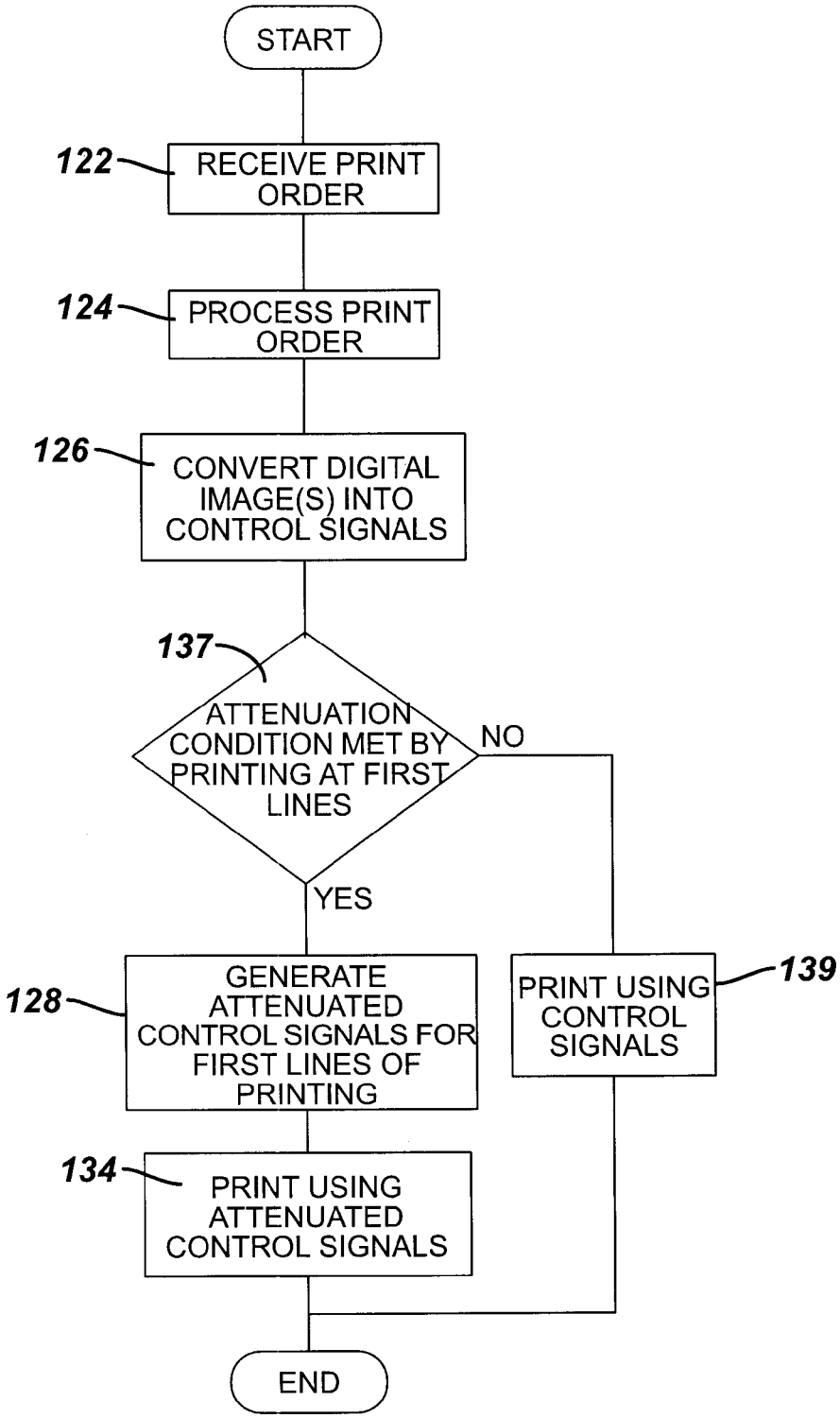
FIG. 12 shows another embodiment of a method for operating a thermal printer to achieve borderless printing with reduced possibility of donor adhesion problems.

FIG. 12 shows the embodiment of FIG. 8A, with the generating step 128 further comprising optional additional steps of determining whether an attenuation condition is met, suggesting that an attenuation pattern should be used. In one example, it is determined that the attenuation condition is met when leading (or trailing) edge of the image to be recorded on receiver medium 20 has image elements that require high density printing (step 137). Typically, this determination can be made by analyzing the density of the colors identified in the digital image data for the leading edge or trailing edge of an image to be printed, by analyzing code values derived from the digital image data, or by analyzing control signals generated for such areas. As noted above, during the printing in these areas there is a higher risk that at least some printing will occur with no receiver medium 20 present between the array of thermal elements 34 of thermal print head 32.

The purpose of this analysis is to identify when the printing of an image may occasion the delivery of sufficient amounts of thermal donor material proximate to a leading or trailing edge of the image to create a risk of the formation of a leading edge web 138 or trailing web 148. This analysis can be performed by totaling the digital image data, code values, or control signals, by calculating an average, for regions of the image proximate to a longitudinal edge. Where this is done a threshold is set as a total above which it is determined that attenuation is to be performed and below which no attenuation is performed. Similarly, statistical means, or other statistical analysis of the digital image data, code values, or control signals can be performed with the outcome thereof compared to a threshold.

Alternatively, this can be done by comparing a pattern of threshold values to a pattern of digital image data, code values or control signals representing areas proximate to an edge of receiver medium 20, such as areas that are printed at a beginning portion of the image or as the printing of the image nears an end. It will be appreciated that any other know statistical, mathematical, neural or other form of analysis can be used in order to analyze the digital image data, code values or control signals for portions of the image that are proximate to an edge of the image to be printed and to characterize the amount of donor material that will be conveyed to print such portions such that a determination can be made as to whether an attenuation condition is met. Such a determination can be made for each donor patch, or for the printed images as a whole. Such a determination can be made based upon image data, code values or control signals for portions of the image to be printed that are proximate to a leading edge of the image, proximate to a trailing edge of the image to be printed or both.

As is noted above, printing conditions may influence the potential for a leading edge web 138 or a trailing web 148 to form. Such printing conditions can be used to adjust a threshold used in the determining step (step 137), or to adjust the analysis performed during the determining step (step 137). For example, for some printers and donor material, where the temperature of the printer is higher then the threshold can be lowered in that there is a lesser chance of donor material adhering to platen 36 at such higher temperatures.

Where it is determined that no such high density printing condition is called for (step 137) the attenuation pattern is not applied to the control signals and the control signals (step 139) are used for printing (step 134). Where it is determined that such a high density printing condition is called for the steps of generating attenuated control signals (step 128) and printing using the attenuated control signals (step 134) can be performed.

The invention has been described in detail with particular reference to certain preferred embodiments thereof, but it will be understood that variations and modifications can be effected within the spirit and scope of the invention.

PARTS LIST

4 sheet
4.1 leader portion or leading edge
4.2 central portion
4.3 trailing portion
6*a* pinch roller
6*b* pinch roller
7 motor
8 print head
10 platen
12 donor roller
14 supply roller
16 donor web
18 bias spring
20 receiver medium
22 leading edge of receiver
23 receiver supply
24 trailing edge of receiver
30 thermal printer
32 thermal print head
34 linear array of thermal elements
36 platen
38 printing nip

40 stepper motor
41 transmission
42 control circuit
43 path of travel
44 donor web
46 donor supply roller
48 donor take-up roller
50 receiver medium advance system
52 pick roller
53 bias spring
54 surface guide
56 surface guide
58 entrance urge roller
60 entrance urge roller
62 urge stepper motor
64 transmission
65 print head guide
70 edge sensor
72 peel plate
80 receiver medium return system
82 return path
84 exit path
86 exit guides
88 exit guides
90 exit urge roller
92 exit urge roller
94 discharge bin
100 interface
102 user input system
104 communication system
106 memory reader
108 keypad
110 mouse
112 display
114 memory card slot
116 memory
118 memory interface
122 receive print order step
124 process print order step
126 obtain image data step
128 form attenuated control signals step
130 convert image data into control signals step
132 attenuate control signals step
134 print using control signals step
135 convert attenuate digital data into control signals step
136 attenuate digital image data step
137 determine high density printing step
138 leading edge web
139 print using control signals step
140 attenuation pattern
140*a* attenuation pattern
140*b* attenuation pattern
142 attenuation pattern
148 trailing web

The invention claimed is:

1. A method for operating a thermal printer having a thermal print head with an array of thermal, elements positioned opposite a platen at a printing nip and with a donor web having thermal donor material positioned between the print head and the platen, said thermal elements being adapted to heat the donor web in accordance with received control signals so that donor material can he transferred from the donor web to a receiver medium; the method comprising the steps of:

moving a leading edge of the receiver medium proximate to the printing nip;

generating a sequence of thermal print head control signals adapted to cause the array of thermal elements to heat in a manner that causes the donor material to transfer from the donor web in a manner that is modulated in accordance with image data and attenuated in accordance with an attenuation pattern; and urging the leading edge of the receiver medium through the printing nip while transmitting the thermal print head control signals to the thermal print head to cause the donor material to transfer from the donor web in an image modulated pattern having a longitudinal length that is larger than a longitudinal length of the receiver medium;

wherein said attenuation pattern provides a level of attenuation at a first portion of a printing that is higher than a level of attenuation at a second portion of the printing receiver medium.

2. The method of claim 1, wherein said first portion of the printing is at a beginning portion of the printing, and wherein said level of attenuation at the first portion of the printing decreases as the printing progresses.

3. The method of claim 1, wherein said attenuation pattern increases the level of attenuation as the printing nears an end.

4. The method of claim 1, wherein an extent of attenuation is further determined based upon properties of the thermal donor material being transferred during the printing.

5. The method of claim 1, wherein an extent of attenuation is determined based upon a size, shape, temperature, cooling rate, adhesive characteristics, or further characteristics of the platen.

6. The method of claim 1, wherein an extent of attenuation is determined based upon a density of image data proximate to a leading or trailing edge of an image defined by the image data.

7. The method of claim 1, wherein said level of attenuation at the first portion of the printing is 90% or greater.

8. The method of claim 1, wherein said first portion of the printing has a greater risk that the receiver medium will not be within the printing nip than said second portion of the printing.

* * * * *

UNITED STATES PATENT AND TRADEMARK OFFICE

CERTIFICATE OF CORRECTION

PATENT NO. : 7,868,906 B2
APPLICATION NO. : 11/747821
DATED : January 11, 2011
INVENTOR(S) : Mindler et al.

It is certified that error appears in the above-identified patent and that said Letters Patent is hereby corrected as shown below:

| Issued Patent | | Description of Error |
|---|---|---|
| **Column** | **Line** | |
| 14 | 3 | In Claim 1, delete "thermal," and insert -- thermal --, therefor. |
| 14 | 8 | In Claim 1, delete "he" and insert -- be --, therefor. |
| 14 | 29 | In Claim 1, delete "receiver medium". |

Signed and Sealed this
Sixteenth Day of August, 2011

David J. Kappos

David J. Kappos
*Director of the United States Patent and Trademark Office*